US006089569A

United States Patent [19]

Trucksess

[11] Patent Number: 6,089,569

[45] Date of Patent: Jul. 18, 2000

[54] TABLE-SLOTS GAME AND METHOD OF PLAY

[76] Inventor: Joseph R. Trucksess, 500 Lake St., Haddon Heights, N.J. 08035

[21] Appl. No.: 09/135,295

[22] Filed: Aug. 17, 1998

Related U.S. Application Data

[60] Provisional application No. 60/073,987, Feb. 6, 1998.

[51] Int. Cl.[7] ..... A63F 1/00

[52] U.S. Cl. ..... 273/292; 273/308

[58] Field of Search ..... 273/292, 309, 273/274, 308; 463/12

[56] References Cited

U.S. PATENT DOCUMENTS

| | | | |
|---|---|---|---|
| D. 263,975 | 4/1982 | Quiroga et al. | D21/37 |
| 3,667,757 | 6/1972 | Holmberg | 273/274 |
| 3,913,919 | 10/1975 | Carpenter | 273/274 |
| 4,234,186 | 11/1980 | Forrest et al. | 273/243 |
| 4,294,451 | 10/1981 | Wollner | 273/308 |
| 5,257,789 | 11/1993 | LeVasseur | 273/309 |
| 5,630,586 | 5/1997 | Lowden | 273/138.2 |
| 5,839,732 | 11/1998 | Guidi | 273/292 |
| 5,921,550 | 7/1999 | Awada | 273/292 |

FOREIGN PATENT DOCUMENTS

| | | |
|---|---|---|
| 964296 | 7/1964 | United Kingdom . |
| 2 124 914 | 2/1984 | United Kingdom . |

OTHER PUBLICATIONS

Slot Machine Card Game, Robert Wollner, "Match A Jackpot Game", "Draw Jackpot Game", pp. 16–19, 1979.
Publication entitled "Casino Golf" dated Dec. 21, 1992.

*Primary Examiner*—Benjamin H. Layno
*Attorney, Agent, or Firm*—Volpe and Koenig, P.C.

[57] ABSTRACT

A card game and method of play are provided. The method includes providing a deck of cards having at least five different symbols thereon and a gaming table with a plurality of player positions, the gaming table including at least three card receiving boxes which are positioned to receive cards dealt from the deck, and each player position including ante receiving areas. The deck of cards is shuffled by the dealer, and an ante is placed in at least one ante receiving area by each player at each of the plurality of the player positions. The dealer deals a card from the shuffled deck into each of the at least three card receiving boxes, and then turns over each of the cards dealt into the first three of the at least three card receiving boxes. A determination is made if a winning combination is present in the first three card receiving boxes. If a winning combination of the cards is present each of the players is paid who placed an ante in the at least one ante receiving area for the first three cards, and if a winning combination is not present in the first three card receiving boxes, the dealer collects all of the antes on the gaming table and starts a new game. If a winning combination was present in the first three cards, the dealer turns over a fourth card, and a further determination is made if a winning combination is present. The dealer then pays off the players who placed an ante in an ante receiving area for the four card combination if a winning combination is present, and if a winning combination is not present, the dealer collects all the remaining ante and starts a new game. This process can continue for a fifth card or additional cards dealt in the card receiving boxes.

13 Claims, 2 Drawing Sheets

42

44

46

48

50

TABLE-SLOTS GAME AND METHOD OF PLAY

CROSS REFERENCE TO RELATED APPLICATIONS

This application claims the benefit of U.S. Provisional Application No. 60/073,987, filed Feb. 6, 1998.

BACKGROUND OF THE INVENTION

The present invention relates to casino table games, and more particularly, to a game which offers slot-machine type play in a table game environment. Slot machines attract a large number of players in casinos due to the ease of use and the simplicity of the wagers offered. Accordingly, slot machines account for a substantial share of the profit in gaming casinos.

However, one drawback of slot machine play is that it lacks appeal for certain types of players since there is no interaction with other players or a dealer. Additionally, the amount of wagers is limited on each play based on the number and denomination of coins which will be accepted by the slot machine. Slot machine play also lacks the comfort of many table games, such as blackjack, where a player is seated at the playing table. This is especially important for older players and senior citizens who do not want to stand at a slot machine or sit on a stool at a slot machine during extended periods of play.

It would be advantageous to casinos to provide a game which has the appeal and simplicity of slot machine play, yet which is offered in a table gaming environment in order to provide the benefit of interaction between players as well as between the player and the dealer. It would also be advantageous to provide a game which removes the limits imposed by a gaming machine on the amount which can be wagered on a given play. It would be similarly advantageous to casinos to provide a new table game for table game players which can have a relatively high rate of play while offering multiple wagering opportunities for the player for each play or deal of the game.

SUMMARY OF THE INVENTION

Briefly stated, the present invention provides a method of playing a card game. The method includes:

(a) providing a deck of cards having at least five different symbols thereon and a gaming table with a plurality of player positions, the gaming table including at least three card receiving boxes which are positioned to receive cards dealt from the deck, and each player position including ante receiving areas;

(b) shuffling the deck of cards by the dealer;

(c) placing an ante in at least one ante receiving area by each player at each of the plurality of the player positions;

(d) the dealer dealing a card from the shuffled deck into each of the at least three card receiving boxes;

(e) turning over each of the cards dealt into the first three of the at least three card receiving boxes; and (f) determining if a winning combination is present in the first three card receiving boxes, and if a winning combination of the cards is present, paying off each of the players who placed an ante in the at least one ante receiving area for the first three cards, and if a winning combination is not present in the first three card receiving boxes, the dealer collecting all of the antes on the gaming table and starting new game.

In another aspect, the present invention provides a table game. The game includes a table having a dealer position and a plurality of player positions. A chip rack is located on the table in front of the dealer position. First, second, third, fourth and fifth card receiving boxes located in front of the chip rack and are adapted to receive cards dealt by a dealer. First, second and third ante receiving areas are located at each of the plurality of player positions. The first ante area adapted to receive wagers on the occurrence of a winning combination of cards in the first through third card receiving boxes. The second ante area adapted to receive wagers on the occurrence of a winning combination of cards in the first through fourth card receiving boxes. A.The third ante area adapted to receive wagers on the occurrence of a winning combination of cards in the first through fifth card receiving boxes. A deck of playing cards is provided which includes fifteen cherry cards, twelve plum cards, ten orange cards, ten lemon cards and five casino logo cards.

BRIEF DESCRIPTION OF THE SEVERAL VIEWS OF THE DRAWINGS

The foregoing summary, as well as the following detailed description of preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF THE INVENTION

Figure 1:
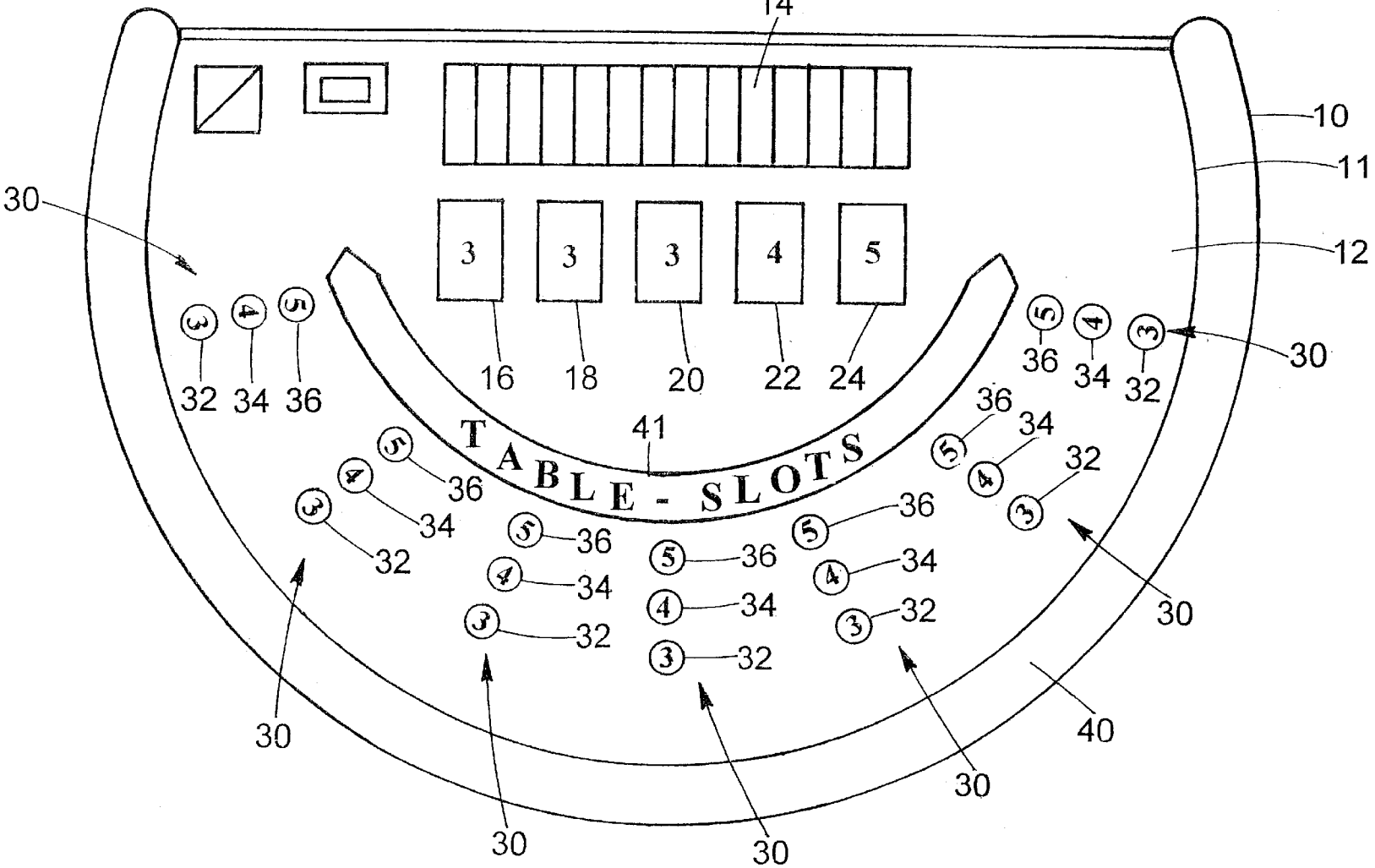
FIG. 1 is a plan view of a gaming table for playing a table-slots game in accordance with the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the gaming table for playing table-slots in accordance with the present invention and designated parts thereof. The terminology includes the words above specifically mentioned, derivatives thereof and words of similar import.

As shown in FIG. 1, in the preferred embodiment of the present invention, a gaming table 10 having a semi-circular top 11 is provided. The top 11 has a covering 12 that is preferably made from felt, but may be made of other any suitable material, if desired. Preferably, the semi-circular top 11 of the table 10 is of a standard size for a casino table game, and the covering 12 is removable such that it may be placed onto an existing table top 10 used in connection with other casino table games such as blackjack.

The covering 12 includes provisions for a chip rack 14, and indicia used in connection with playing the game, which are described in more detail below, are printed on the covering 12. The chip rack 14 is located adjacent to the dealer area. Boxes 16, 18, 20, 22 and 24 are located on the covering 12 in front of the chip rack 14. The boxes 16, 18, 20, 22, 24 are preferably printed or silk-screened onto the covering 12. However, it will be recognized by those skilled in the art from the present disclosure that the boxes can be produced by any other suitable means, such as adhering another layer of material to the covering 12. Preferably, boxes 16, 18 and 20 also include the printed indicia "3". The fourth box 22 includes the printed indicia "4", and the fifth box 24 includes the printed indicia "5". The boxes 16, 18, 20, 22, 24 are preferably sized such that a playing card can be placed within the box. It will be recognized by those skilled in the art from the present disclosure that the particular form, shape and location of the boxes 16, 18, 20, 22 and 24 on the table may be varied, if desired.

Preferably, seven player positions 30 are located around the semi-circular portion of the table 10. Each player position 30 includes a first wagering area in the form of a first circle 32 for a player's first ante. A second wagering area is provided in the form of a circle 34 for the player's second ante and a third wagering area in the form of a circle 36 is provided for the player's third ante. The first circle 32, second circle 34 and the third circle 36 are preferably marked with indicia "3", "4", and "5", respectively. The wagering areas 32, 34, 36 and the associated indicia "3", "4", and "5" are also preferably silk-screened or printed on the covering 12, but may be applied by other means, if desired. The shape can also be varied as desired. It will be recognized by those skilled in the art from the present disclosure that the number of boxes 16, 18, 20, 22 and 24 for receiving cards as well as the number of areas for the player's antes may be varied, if desired, depending upon the number of wagers which are to be made available for a given deal or play. It will be similarly recognized that the number of player locations 30 may be varied to suit particular sizes of gaming tables.

The table 10 also preferably includes a cushioned rail 40 of the type generally known in the art. However, this can be eliminated, if desired. Printed indicia 41 identifying the game, the casino name or any other desired markings, may also be added to the covering 12 in a location that does not interfere with the game layout.

Figure 2A:
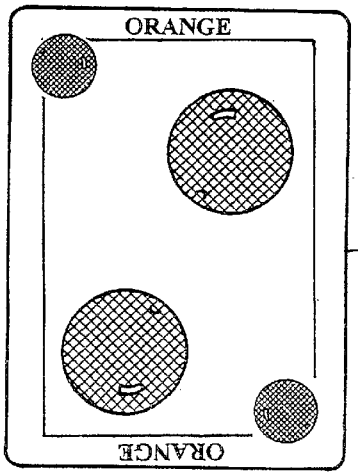
FIGS. 2*a*–2*e* are plan views of faces of playing cards used in connection with the game in accordance with the preferred embodiment of the present invention.
Figure 2B:
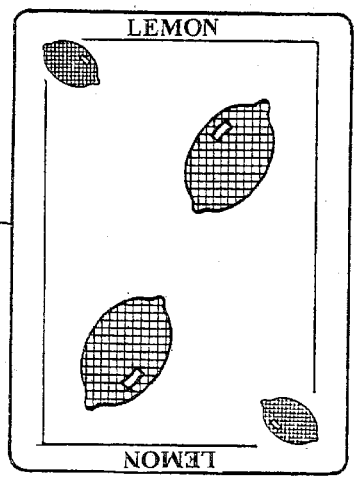
Figure 2C:
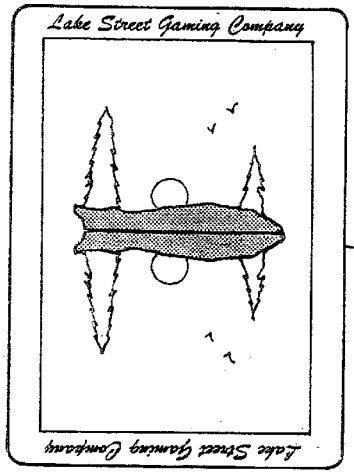
Figure 2D:
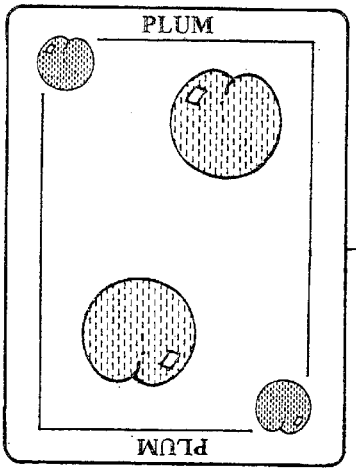
Figure 2E:
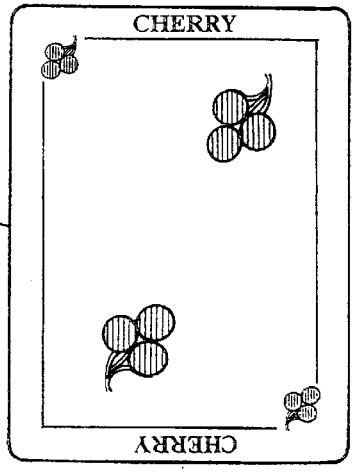

Referring now to FIGS. 2*a*--2*e*, in a first preferred embodiment, playing cards are provided having indicia which are typical of slot machines. Preferably, the playing cards are provided in a deck of fifty (50) cards, with ten (10) orange cards 42, as shown in FIGS. 2*a*; eight (8) lemon cards 44, as shown in FIG. 2*b*; five (5) logo cards 46, which may include any logo, such as the casino logo, as shown in FIG. 2*c*; twelve (12) plum cards 48, as shown in FIG. 2*d*; and fifteen (15) cherry cards 50, as shown in FIG. 2*e*. However, it will be recognized by those skilled in the art from the present disclosure that the number of cards 42, 44, 46, 48, 50 may be varied, as desired, in order to achieve the desired odds for casino wins and/or for a desired payout ratio. For example, in a second preferred embodiment, a deck of fifty-two (52) cards is provided, with fifteen (15) cherry cards 50, twelve (12) plum cards 48, ten (10) orange cards 42, ten (10) lemon cards 44 and five (5) casino logo cards 46. It will be similarly recognized that various other symbols may be used on the cards, such as "BAR", "7", etc.

In order to play the game, a deck of table-slots cards 42, 44, 46, 48, 50 is shuffled by hand by the dealer and then placed into an automatic shuffling machine. A second deck is also shuffled in a similar manner. Preferably, after the second deck of cards is shuffled, the dealer again shuffles the first deck in the shuffling machine. At this time, each player may place a minimum ante or optionally a larger wager in one or more of the wagering areas 32, 34 and 36. Five cards are then dispensed from the first deck into a holding tray. Preferably, these cards are placed in the discard rack and not used. The second five cards are then placed face down in order in boxes 16, 18, 20, 22 and 24 by the dealer.

The first three cards in boxes 16, 18 and 20 are then turned over beginning at the far left on the player's side. The dealer then pays each player that has placed the ante or a larger wager in the first wagering area 32 if a winning combination is present for the first three cards. In the first preferred embodiment using the deck of fifty (50) cards, the winning combinations for the first three cards and payoffs for a one dollar wager are as follows:

| Winning Combinations Three Card Game | Payoff in Dollars |
|---|---|
| C-*-* | 1 |
| C-C-C | 2 |
| P-*-* | 1 |
| P-P-P | 2 |
| O-*-* | 1 |
| O-O-O | 5 |
| L-L-L | 10 |
| CL-CL-CL | 100 |

*Represents any symbol

If a winning combination does not occur, then all antes and/or wagers on the table are collected, and the dealer begins a new hand with the second deck. If a winning combination occurs in the first three cards, once the winning bets are paid the dealer turns over the card in the fourth box 22. The four card winning combinations incorporate the first three cards turned over in the first three boxes 16, 18, 20 as well as the card in the fourth box 22. If this results in a winning four card combination, the dealer will again pay each player who has placed an ante or a larger wager in the second wagering area 34. In the first preferred embodiment using the deck of fifty (50) cards, preferably the players are paid off for winning bets in accordance with the following payout schedule for each one dollar wagered.

| Winning Combinations Four Card Game | Payoff in Dollars |
|---|---|
| C-C-C-C | 50 |
| P-P-P-P | 75 |
| O-O-O-O | 100 |
| L-L-L-L | 200 |
| CL-CL-CL-CL | 1,000 |

If a winning combination does not occur, then all antes and/or wagers remaining on the table are collected, and the dealer begins a new hand with the second deck. If a winning combination of four cards occurs, after the winning bets are paid for antes or larger wagers in the second wagering area 34 for each player, the dealer turns over the card in the fifth box 24. Winning combinations which can result in a payoff for the third wagering area 36 incorporate the combination of all five cards in boxes 16, 18, 20, 22 and 24. Again, if a winning combination occurs the dealer pays the winning players. In the first preferred embodiment using the deck of fifty (50) cards, the payouts for winning combinations of five cards is as shown below for a one dollar wager.

| Winning Combinations Five Card Game | Payoff in Dollars |
|---|---|
| C-C-C-C-C | 200 |
| P-P-P-P-P | 400 |
| O-O-O-O-O | 500 |
| L-L-L-L-L | 1,000 |
| CL-CL-CL-CL-CL | 50,000 |

Once the hand is completed, the dealer places all the cards from the first deck, whether played or unplayed, in the discard rack. The dealer then riffles twice and places the cards back into the shuffling machine. During this time the dealer begins a second game using the second deck.

In the second preferred embodiment in which the deck of fifty-two (52) cards is utilized, the game is dealt in the same manner described above for the first embodiment. Preferably, the winning combinations for the first three cards and payoffs for a one dollar wager are as follows:

| Winning Combinations Three Card Game | Payoff in Dollars |
|---|---|
| C-*-* | Push |
| C-C-C | 1 |
| P-*-* | Push |
| P-P-P | 1 |
| O-*-* | 1 |
| O-O-O | 2 |
| L-L-L | 5 |
| CL-CL-CL | 25 |

*Represents any symbol

The winning combinations for the first four cards and payoffs for a one dollar wager are as follows:

| Winning Combinations Four Card Game | Payoff in Dollars |
|---|---|
| C-C-C-C | 50 |
| P-P-P-P | 100 |
| O-O-O-O | 200 |
| L-L-L-L | 400 |
| CL-CL-CL-CL | 500 |

The winning combinations for five cards and payoffs for a one dollar wager are as follows:

| Winning Combinations Five Card Game | Payoff in Dollars |
|---|---|
| C-C-C-C-C | 250 |
| P-P-P-P-P | 500 |
| O-O-O-O-O | 1,000 |
| L-L-L-L-L | 2,500 |
| CL-CL-CL-CL-CL | 50,000 |

It will be recognized by those skilled in the art from the present disclosure that the use of a shuffling machine, the number of card decks and the particular shuffling employed can be varied, as desired. Additionally, less frequent shuffling can be provided by using multiple decks such that the dealer could deal several games prior to reshuffling.

It will be similarly recognized by those skilled in the art from the present disclosure that the number of cards used in each game can be varied. For example, more or less than five card receiving boxes 16, 18, 20, 22, 24 may be provided. While the payout tables provided above are preferred, it will be recognized by those skilled in the art from the present disclosure that other payout tables may be used, if desired.

The present game provides the excitement of slot machine play in a table gaming environment. It also provides the opportunity to make several wagers for a single deal in order to increase the number of wagers or gaming decisions which are made per unit time.

It will be appreciated by those skilled in the art that changes could be made to the embodiments described above without departing from the broad inventive concept thereof It is understood, therefore, that this invention is not limited to the particular embodiments disclosed, but it is intended to cover modifications within the spirit and scope of the present invention as defined by the appended claims.

What is claimed is:

1. A method of playing a card game comprising:

(a) providing a deck of cards having at least five different symbols thereon and a gaming table with a plurality of player positions, the gaming table including five card receiving boxes which are positioned to receive cards dealt from the deck, and each player position including three ante receiving areas for each of the player positions;

(b) shuffling the deck of cards by the dealer;

(c) placing an ante in at least one ante receiving area by a player at each of the plurality of the player positions;

(d) the dealer dealing a card from the shuffled deck into each of the five card receiving boxes;

(e) turning over each of the cards dealt into the first three of the at least three card receiving boxes;

(f) determining if a winning combination is present in the first three card receiving boxes, and if a winning combination of the cards is present, paying off each of the players who placed an ante in the at least one ante receiving area for the first three cards, and if a winning combination is not present in the first three card receiving boxes, the dealer collecting all of the antes on the gaming table and starting new game;

(g) if a winning combination is present in the first three cards, after paying off each of the players who placed an ante in the at least one ante receiving area for the first three cards, turning over the fourth card dealt into the fourth card receiving box;

(h) determining if a winning combination is present in the first four card receiving boxes, and if a winning combination of cards is present in the first four card receiving boxes, paying off each of the players who placed an ante in the ante receiving area for the first four cards, and if a winning combination is not present in the first four card receiving boxes, the dealer collecting all of the antes remaining on the gaming table and starting new game;

(i) if a winning combination was present in the first four cards, after paying off each of the players who placed an ante in the ante receiving area for the first four cards, turning over the fifth card dealt into the fifth card receiving box; and (j) determining if a winning combination is present in the five card receiving boxes, and if a winning combination of cards is present in the five card receiving boxes, paying off each of the players who placed the ante in the ante receiving area for the five cards, and if a winning combination is not present in the five card receiving boxes, the dealer collecting all of the antes remaining on the gaming table and starting new game.

2. The method of claim 1, further comprising providing a deck of cards including fifteen cherry cards, twelve plum cards, ten orange cards, ten lemon cards and five casino logo cards, wherein determining if the winning combination is present after the first three cards are turned over includes determining if one of the following winning combinations of the cards is present;

C-*—*,

C—C—C,

P-*—*,

P—P—P,

O-*—*,

O—O—O,

L—L—L,

CL—CL—CL, wherein C represents cherry cards, P represents plum cards, O represents orange cards, L represents lemon cards, CL represents club logo cards, and * represents any symbol.

3. The method of claim 2 wherein if one of the winning combinations is present after the first three cards are turned over, paying off each of the players according to the following for each dollar anted:

| | |
|---|---|
| C-*-* | Push, |
| C-C-C | 1, |
| P-*-* | Push, |
| P-P-P | 1, |
| O-*-* | 1, |
| O-O-O | 2, |
| L-L-L | 5, and |
| CL-CL-CL | 25. |

4. The method of claim 3 wherein determining if the winning combination is present after the first four cards are turned over includes determining if one of the following winning combinations of the cards is present;

C—C—C—C,

P—P—P—P,

O—O—O—O,

L—L—L—L, and

CL—CL—CL—CL.

5. The method of claim 4 wherein if one of the winning combinations of the four cards is present after the fourth card is turned over, paying off each of the players according to the following for each dollar anted:

| | |
|---|---|
| C-C-C-C | 50, |
| P-P-P-P | 100, |
| O-O-O-O | 200, |
| L-L-L-L | 400, and |
| CL-CL-CL-CL | 500. |

6. The method of claim 5 wherein determining if a winning combination is present after the five cards are turned over includes determining if one of the following combinations of the cards is present;

C—C—C—C—C,

P—P—P—P—P,

O—O—O—O—O,

L—L—L—L—L, and

CL—CL—CL—CL—CL.

7. The method of claim 6 wherein if one of the winning combinations of the five cards is present after the fifth card is turned over, paying off each of the players according to the following for each dollar anted:

| | |
|---|---|
| C-C-C-C-C | 250, |
| P-P-P-P-P | 500, |
| O-O-O-O-O | 1,000, |
| L-L-L-L-L | 2,500, and |
| CL-CL-CL-CL-CL | 50,000. |

8. The method of claim 1, further comprising providing a deck of cards including fifteen cherry cards, twelve plum cards, ten orange cards, eight lemon cards and five casino logo cards, wherein determining if the winning combination is present after the first three cards are turned over includes determining if one of the following winning combinations of the cards is present;

C-*—*,

C—C—C,

P-*—*,

P—P—P,

O-*—*,

O—O—O,

L—L—L,

CL—CL—CL, wherein C represents cherry cards, P represents plum cards, O represents orange cards, L represents lemon cards, CL represents club logo cards, and * represents any symbol.

9. The method of claim 8 wherein if one of the winning combinations is present after the first three cards are turned over, paying off each of the players according to the following for each dollar anted:

| | |
|---|---|
| C-*-* | 1, |
| C-C-C | 2, |
| P-*-* | 1, |
| P-P-P | 2, |
| O-*-* | 1, |
| O-O-O | 5, |
| L-L-L | 10, and |
| CL-CL-CL | 100. |

10. The method of claim 9 wherein determining if the winning combination is present after the first four cards are turned over includes determining if one of the following winning combinations of the cards is present;

C—C—C—C,

P—P—P—P,

O—O—O—O,

L—L—L—L, and

CL—CL—CL—CL.

11. The method of claim 10 wherein if one of the winning combinations of the four cards is present after the fourth card is turned over, paying off each of the players according to the following for each dollar anted:

| | |
|---|---|
| C-C-C-C | 50, |
| P-P-P-P | 75, |
| O-O-O-O | 100, |
| L-L-L-L | 200, and |
| CL-CL-CL-CL | 1,000. |

12. The method of claim 11 wherein determining if a winning combination is present after the five cards are turned over includes determining if one of the following combinations of the cards is present;

C—C—C—C—C,

P—P—P—P—P,

O—O—O—O—O,

L—L—L—L—L, and

CL—CL—CL—CL—CL.

13. The method of claim 12 wherein if one of the winning combinations of the five cards is present after the fifth card is turned over, paying off each of the players according to the following for each dollar anted:

| | |
|---|---|
| C-C-C-C-C | 200, |
| P-P-P-P-P | 400, |
| O-O-O-O-O | 500, |
| L-L-L-L-L | 1,000, and |
| CL-CL-CL-CL-CL | 50,000. |

* * * * *